United States Patent [19]

Mainland

[11] Patent Number: 5,018,293

[45] Date of Patent: May 28, 1991

[54] SHOTGUN SHELL EJECTOR/EXTRACTOR MEANS FOR SKEET GUN CARRIER BARREL HAVING SMALLER GAUGE TUBE THEREIN

[75] Inventor: Donald R. Mainland, Racine, Wis.

[73] Assignee: Kolars Arms, Racine, Wis.

[21] Appl. No.: 413,461

[22] Filed: Sep. 27, 1989

[51] Int. Cl.[5] ..... F41A 21/10

[52] U.S. Cl. ..... 42/77; 42/46

[58] Field of Search ..... 42/46, 47, 77; 89/29

[56] References Cited

U.S. PATENT DOCUMENTS

| | | | |
|---|---|---|---|
| 3,196,569 | 7/1965 | Thomason | 42/77 |
| 3,339,304 | 9/1967 | Knode et al. | 42/77 |
| 3,979,851 | 9/1976 | Soucy | 42/77 |
| 4,220,071 | 9/1980 | Seiderman | 42/77 |

*Primary Examiner*—Stephen C. Bentley

*Attorney, Agent, or Firm*—Nilles & Nilles

[57] ABSTRACT

A detachable large-bore regular barrel of a shotgun is replaced by a light-weight, thin-walled, carrier barrel having a bore in which a smaller-bore tube and an adapter are mounted. This enables the shotgun to fire a smaller-gauge shotgun shell without changing the weight and balance of the gun, since the combined weight of the carrier barrel, tube and adapter matches that of the regular barrel and those parts are designed to provide the same balance. The carrier barrel is provided with the same kind of shell ejector/extractor as the regular barrel. The adapter comprises a tubular member which defines a firing chamber for the smaller-gauge shotgun shell and is disposed in the breech end of the carrier barrel bore, being threadedly connected to the tube therein. The tubular member of the adapter prevents inadvertent insertion of a larger gauge shotgun shell into the carrier barrel and thus provides a safety feature. The adapter further comprises a slidable component which is slidably mounted on the breech end of the tubular member and engages a flange on the base end of the smaller gauge shotgun shell in the firing chamber of the tubular member. The slidable component is engaged with the ejector/extractor on the carrier barrel and is responsive to movement thereof from retracted to either eject or extract position to effect ejection or extraction of the smaller gauge shotgun shell.

13 Claims, 3 Drawing Sheets

SHOTGUN SHELL EJECTOR/EXTRACTOR MEANS FOR SKEET GUN CARRIER BARREL HAVING SMALLER GAUGE TUBE THEREIN

BACKGROUND OF THE INVENTION

1. Field of Use

This invention relates to replacement means for replacing a detachable regular barrel of a shotgun to enable firing of a smaller-gauge shotgun shell without altering the weight and balance of the shotgun.

In particular, it relates to improved shell ejector/extractor means in such replacement means.

2. Description of the Prior Art

One type of shotgun comprises a receiver, a shoulder stock connected to the rear of the receiver, a fore-end iron pivotally connected to the front of the receiver, and a regular barrel detachably connected to the fore-end iron. The regular barrel may have a single bore or a double-bore (side-by-side or over-and-under). In any case, each bore has a predetermined gauge and is adapted to have a shotgun shell of the same gauge fired therein. The regular barrel has a shell ejector/extractor which is operated by an ejector/extractor operating mechanism which is mounted on the shotgun, either in the receiver or on the fore-end iron. This mechanism is constructed so as to ascertain whether or not a shotgun shell in a barrel bore has been fired. This mechanism is actuated when the regular barrel is swung or pivoted downwardly from breech-closed to breech-open position to effect forceful ejection of a spent shell casing or to effect slight movement of an unfired live shell to a position wherein it can be manually removed.

A 12 gauge double-barrel over-and-under shotgun of the aforedescribed type, designated as a Model K-80 Skeet Gun, is manufactured by Krieghoff International, Inc., of West Germany, and is commercially available in the U.S.A. through P.O. Box 549, Ottsville, Pa., 18942.

Heretofore, if a shooter using a shotgun of the aforesaid type desired to fire shotgun shells of smaller gauge than the predetermined gauge, either to comply with the rules of a different class of sport shooting or for reasons of economy, he had two options. First, he could replace the detachable regular barrel with a compatible replacement barrel of the desired smaller gauge. However, this required having available one or more replacement barrels, each of which is extremely expensive. However, the advantage of this first option is that a replacement barrel of smaller gauge can be constructed to have the same weight and balance as the regular barrel so as not to affect the aim or technique of the shooter. Second, instead of replacing the regular barrel with a replacement barrel he could insert therein a tube having a firing chamber and bore of the desired smaller gauge. Such tubes are commercially available individually or in sets of different smaller gauges. While this second option is more economical than the first, the major disadvantage is that the use of the tube in the bore of the regular barrel added to the overall weight of the shotgun and changed its balance, thereby adversely affecting the aim and technique of the shooter.

SUMMARY OF THE INVENTION

The present invention provides means for replacing a detachable regular barrel of a shotgun to enable firing of a smaller-gauge shotgun shell without altering the weight and balance of the shotgun.

The invention is applicable to a shotgun having a receiver, a fore-end iron pivotally connected to the receiver, a regular barrel (single or double-bored) detachably connected to the fore-end iron, a shell ejector/extractor mounted on the regular barrel, and an ejector/extractor operating mechanism mounted on the receiver or the fore-end iron.

The means for replacing the regular barrel comprise a carrier barrel (single or double-bored) having a shell ejector/extractor mounted thereon, a smaller-gauge tube for each carrier barrel bore) and an adapter for each carrier barrel bore connectable to the tube therein.

The carrier barrel bore (or bores) has the same nominal gauge as the regular barrel bore (or bores) but has thinner bore walls and is substantially lighter in weight than the regular barrel and is not adapted or intended to have a shotgun shell of the said nominal gauge fired therein as this could cause damage to the gun and/or injury to the shooter.

However, the adapter for each bore comprises or defines a safe firing chamber for a smaller-gauge shotgun shell and its associated tube is adapted to have the smaller-gauge shell fired therethrough safely.

The adapter further comprises shell ejector/extractor means operable by the shell ejector/extractor mounted on the carrier barrel which, in turn, is operated by the shell ejector/extractor operating mechanism on the shotgun, either in the receiver or on the fore-end iron.

In accordance with this invention, the combined weight of the replacement means, i.e. the carrier barrel with its shell ejector/extractor thereon, the tube (or tubes) and the adapter (or adapters), equals the weight of the regular barrel (with its ejector/extractor) which it replaces. Furthermore, the components comprising the aforesaid replacement means are sized, shaped, constructed and arranged so that, when assembled, they exhibit or have the same balance as the regular barrel which they replace.

The adapter which is connected to the rear end of the tube fits within the carrier barrel bore and is chambered to receive the smaller-gauge shotgun shell which is to be fired therein. The adapter comprises two components, namely, a tubular member defining a firing chamber which, when installed, is stationary relative to the carrier barrel and aligned with the tube, and a movable component which serves as a shell ejector/extractor which is slidably mounted on a side of the tubular member and is axially movable between a retracted position and either of two extended positions (eject or extract). The movable component, which is engageable with the ejector/extractor on the carrier barrel and with a conventional flange on the base of a shotgun shell inserted in the firing chamber of the tubular member, operates in response to movement of the ejector/extractor on the carrier barrel as the gun breech is opened to effect ejection or extraction of the shotgun shell. The tubular member, when disposed in the carrier barrel bore, prevents inadvertent insertion of a 12 gauge shotgun shell into the carrier barrel in which it would otherwise fit and thus provides a safety function.

The means in accordance with the present invention provides several advantages over the prior art. For example, a shotgun employing such means has a weight and balance which is identical to that which the shotgun has when the regular barrel is used. As a result, the gun handles in the same manner, has the same "feel" to the shooter and does not disrupt his aim or shooting technique even though the shooter is firing a smaller shotgun shell than when the regular barrel is used. From a safety standpoint, the design and arrangement of the adapter in the carrier barrel bore prevents inadvertent insertion of a 12 gauge shotgun shell in the carrier barrel which, otherwise, could accommodate such a shell. Furthermore, the adapter takes advantage of the ejector/extractor already mounted on the carrier barrel to effect ejection or extraction of a smaller gauge shotgun shell inserted in the adapter. The adapter is relatively simple in construction, employing only two components; is reliable in use since only one component is movable during operation; is economical to manufacture; and is easy to install in the field. The adapter is threadedly engaged with the tube installed in the carrier barrel and unintentional axial or rotational displacement of the adapter relative to the carrier barrel is prevented, thereby ensuring that the adapter is always disposed in the correct operating position. The invention disclosed herein is embodied in an "over-and-under" type double-barrel shotgun of 12 gauge bore, but can be embodied in any shotgun having a replaceable regular barrel with at least one bore and having an ejector/extractor operating mechanism which operates a shell ejector/extractor on the regular barrel. Other objects and advantages of the invention will hereinafter appear.

DESCRIPTION OF A PREFERRED EMBODIMENT

Figure 1:
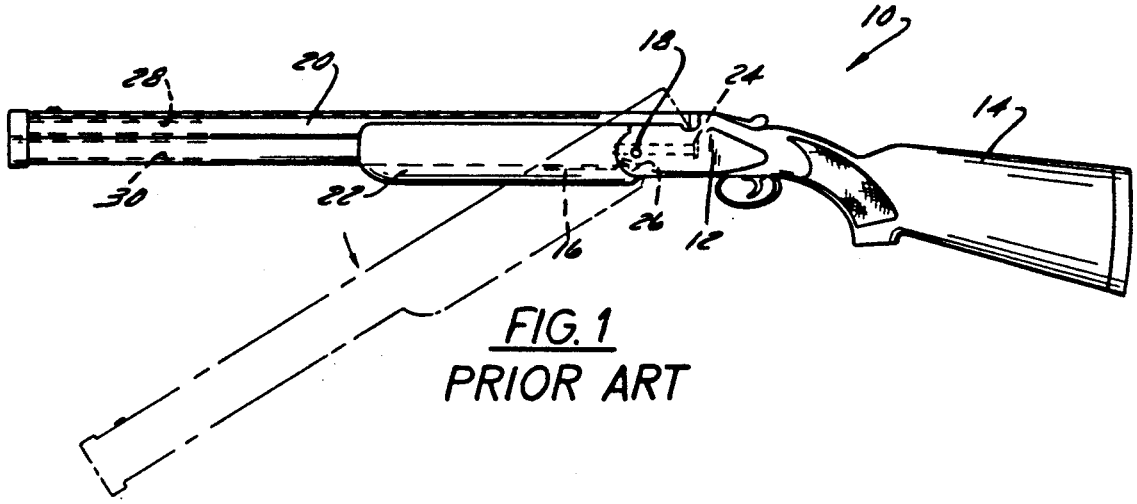
FIG. 1 PRIOR ART
FIG. 1 is a side elevation view of a prior art shotgun having a regular over-and-under two-bore barrel and showing in phantom lines the breach-open position for the regular barrel.
Figure 2:
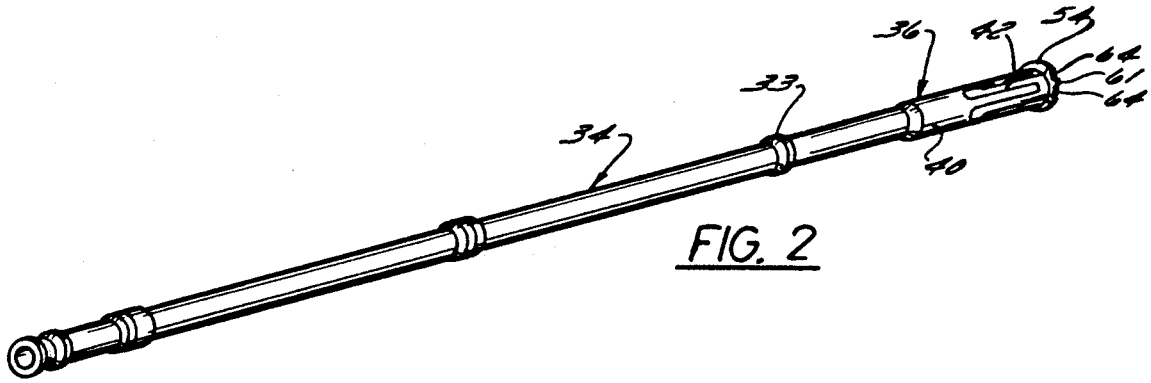
FIG. 2 is an enlarged perspective of the smaller-gauge tube and an adapter for installation in a carrier barrel, shown in FIGS. 3, 4, 6 and 7, in accordance with the present invention.

FIG. 1 shows an over-and-under two-bore shotgun 10 of a type in which replacement means in accordance with the present invention can be employed. Shotgun 10 generally comprises a receiver 12, a shoulder stock 14 connected to the rear of the receiver, a fore-end iron 16 pivotally connected to the front of the receiver by a pivot pin 18, a regular barrel 20 (double-barrel over-and-under type) detachably mounted on the fore-end iron, and a fore-end wood hand grip 22 rigidly mounted on the fore-end iron. Regular barrel 20, which has an upper bore 28 and a lower bore 30, is provided with two ejector/extractors 24 (only one visible in FIG. 1) for ejecting or extracting shotgun shells (not visible) from the barrel when the gun breech is opened. Each ejector-/extractor 24 is operated between a retracted position (not shown) and either of two extended positions (not shown) by an ejector/extractor operating mechanism 26 (FIG. 3) in response to opening and closing the breech.

Shotgun 10 takes the form of a double-barrel "over-and-under" type shotgun, such as is used in skeet shooting, and its regular barrel 20 has an upper bore 28 and a lower bore 30, both of which are of the same gauge, such as 12 gauge for example, and each is adapted to receive and have a 12 gauge shotgun shell (not shown) fired therein. Shotgun 10 is understood to have a certain weight and a certain balance and its regular barrel 20, together with its two ejector/extractors 24, when detached from shotgun 10, has a certain predetermined weight and balance.

Figure 3:
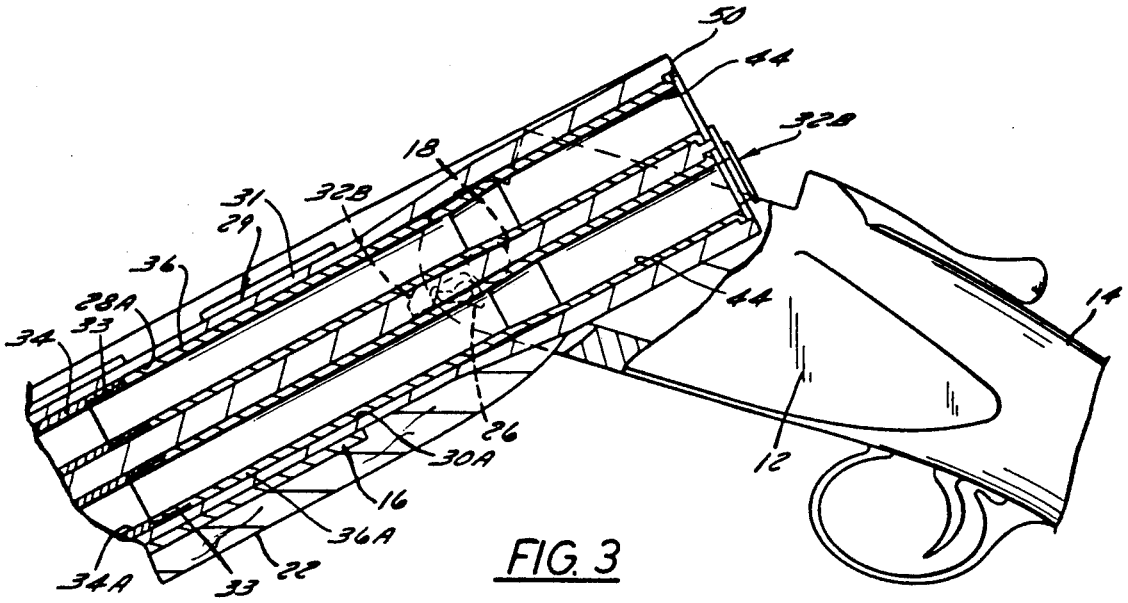
FIG. 3 is an enlarged elevation view, partly in cross-section, of a portion of a shotgun employing a carrier barrel, shown in breech-open position, in place of the regular barrel of FIG. 1, and having tubes and adapters installed therein in accordance with the present invention.

Referring to FIG. 3, replacement means in accordance with the present invention are provided in order to enable or adapt shotgun 10 to accommodate and fire shotgun shells smaller than 12 gauge without changing the weight and balance of the shotgun. Such replacement means generally comprise several major components which replace detachable regular barrel 20 which has the two ejector/extractors 24 mounted thereon. As FIG. 3 shows, these major components are: a carrier barrel 29 having an upper bore 28A and a lower bore 30A; two ejector/extractors 32 (only one shown in FIGS. 4, 6, 7 and 8) mounted on the carrier barrel; two tubes 34 and 34A, each mountable in one bore of the carrier barrel; and two adapters 36 and 36A detachably connected to a respective tube and mountable in the carrier barrel. The combined weight of these major components is equal to or matches the combined weight of regular barrel 20 and its ejector/extractors 24. Furthermore, the major components are designed, constructed, shaped and sized so that, when fully assembled, the resultant structure matches or has the same balance as regular barrel 20 and its two ejector/extractors 24.

Referring to FIG. 3, carrier barrel 29 is generally similar in appearance to regular barrel 20 and has an upper bore 28A and a lower bore 30A; and each bore is 12 gauge i.e., the same as the bores 28 and 30 of regular barrel 20. However, since carrier barrel 29 must be substantially lighter in weight than regular barrel 20, its bore walls are thinner, as at 31 in FIG. 3, and less strong than those of regular barrel 20. Therefore, though each bore 28A and 30A is able to receive a 12 gauge shotgun shell, carrier barrel 29 is not designed to and cannot withstand firing of a 12 gauge shotgun shell therein. Carrier barrel 29 is detachably mountable on fore-end iron 16 of shotgun 10 in the same manner and the same position as regular barrel 20 (see FIGS. 1 and 3).

Figure 4:
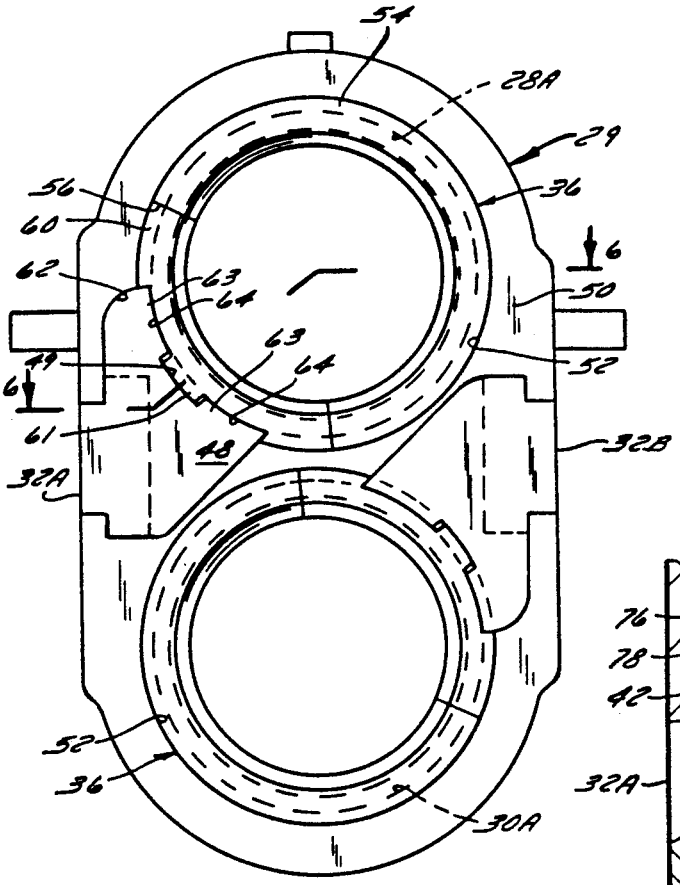
FIG. 4 is a greatly enlarged elevation view of the breach end of the carrier barrel, the ejector/extractor thereon and the adapter installed therein as shown in FIG. 3.

Referring to FIG. 4, carrier barrel 29 is provided with two ejector/extractors 32A and 32B which are substantially identical in all respects, except as hereafter explained, to the ejector/extractors 24 on regular barrel 20. The ejector/extractors 32A and 32B are each movable between a retracted position (FIG. 6) and either of two extended positions extract position shown in (FIG. 7) by means of ejector/extractor operating mechanism 26 on receiver 12 of shotgun 10 (see FIG. 3). Each ejector/extractor 32A and 32B moves from retracted to extended position when carrier barrel 29 is swung down to breach-open position (clockwise in FIG. 3). Each ejector/extractor 32A, 32B is designed and operates to effect ejection or extraction of a shotgun shell associated with its respective bore, either upper bore 28A or lower bore 30A, as hereafter explained in detail. Operating mechanism 26 is of a known type and is able to ascertain whether a shotgun shell in a barrel bore has been fired or not. In case the shell in bore 28A has been fired and the breech is opened, ejector/extractor 32A move to a greatly extended position (not shown) and effects ejection of the spent shell casing from the gun. In case the shell in bore 28A has not been fired and the breech is opened, ejector/extractor 32A effect movement of the shell outwardly for a smaller distance to extract position (see FIG. 7) so that it can be manually withdrawn from the barrel.

Referring to FIG. 4, it is seen that each ejector/extractor 32A, 32B is mechanically and operatively associated with either upper bore 28A or lower bore 30A in the same manner, although there is a reversal of certain parts. Furthermore, each tube 34, 34A is identical to the other and each adapter 36, 36A is identical to the other. Therefore, to simplify the following discussion, only tube 34 and adapter 36 associated with upper bore 28A and their relationship to their respective ejector/extractor 32A will be described in detail; it being understood that the tube 34A and adapter 36A in lower bore 30A are constructed and operated in the same manner.

Figure 7:
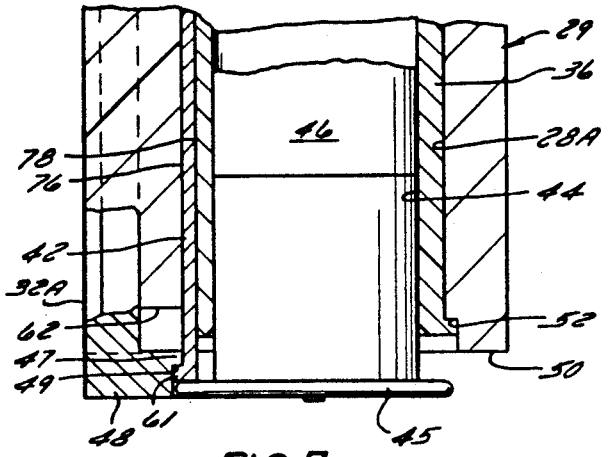
FIG. 7 is a view similar to FIG. 6 showing the ejector/extractor, and a component of the adapter in extended position.

Referring to FIG. 3, as previously explained, carrier barrel 29 is structurally weaker than regular barrel 20 and is subject to damage if a 12 gauge shotgun shell adapted for firing in regular barrel 20 is fired in either bore 28A or 30A in the carrier barrel. Tube 34 is mountable in upper bore 28A of carrier barrel 29 and adapted to have a smaller gauge shotgun shell 46 (FIGS. 6 and 7) fired therethrough. Adapter 36 is mountable in bore 28A of carrier barrel 29 and is threadedly connectable to tube 34 as at 33 (see FIGS. 2, 3 and 9) for receiving the smaller gauge shotgun shell 46 which is to be fired therein. As FIGS. 2, 5, 8 and 9 show, adapter 36 comprises a tubular member 40 having a movable component 42 slidably mounted thereon and operable by shell ejector/extractor 32A on carrier barrel 29 to eject or extract the smaller gauge shotgun shell 46 from the adapter. Adapter 36, when mounted in upper bore 28A prevents insertion into carrier barrel bore 28A of a 12 gauge shotgun shell (not shown) which is otherwise capable of being fired in bore 28 of regular barrel 20 and bore 28A in carrier barrel 29. Referring to FIGS. 6 and 7, tubular member 40 of adapter 36 has a firing chamber 44 therein for receiving the smaller gauge shotgun shell 46. Movable component 42 is slidably mounted on tubular member 40 and is engaged with a flange 45 on the base of smaller gauge shotgun shell 46 when the shell is disposed in firing chamber 44. Movable component 42 is enagageable with and movable by ejector/extractor 32A for upper bore 28A of carrier barrel 29 when adapter 36 is disposed in carrier barrel bore 28A.

Figure 8:
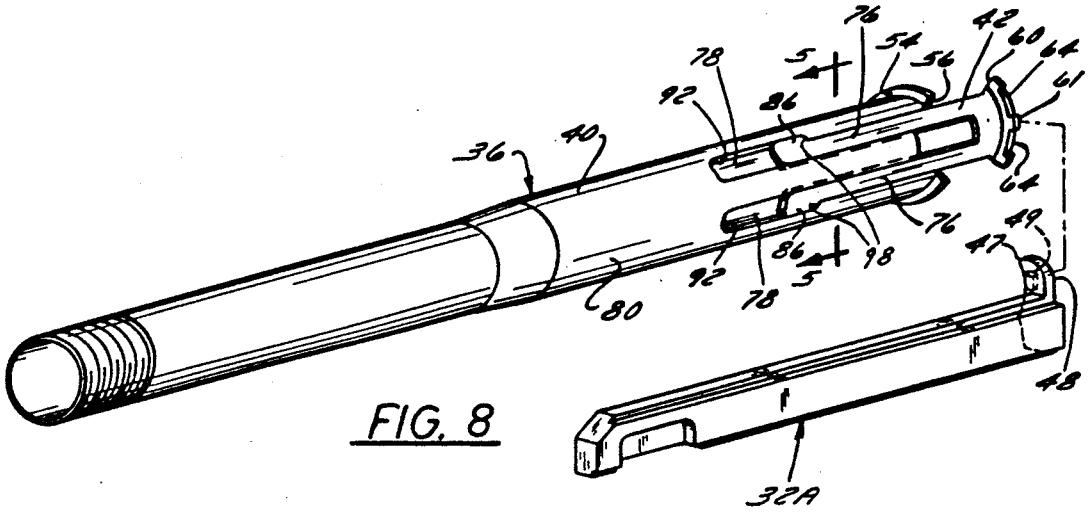
FIG. 8 is an exploded perspective view of the adapter and a portion of the ejector/extractor of the carrier barrel which effects operation thereof.

As FIG. 8 shows, the ejector/extractor 32A for upper bore 28A of carrier barrel 29 comprises a member 48 which is engageable with movable component 42 of adapter 36 and is slidably movable between a retracted position (FIG. 6) and an either of two extended positions (extract position is shown in FIG. 7). Movable components 42 of adapter 36 is also slidably movable between a retracted position (FIGS. 6 and 9) and either of two extended positions (FIGS. 7 and 8) show the extract position. Movable component 42 is movable from its retracted position to either of its extended positions to eject or extract smaller gauge shotgun shell 46 from firing chamber 44.

As FIGS. 3 and 4 show, carrier barrel 29 has a flat planar surface 50 at its breach end whereat bore 28A in carrier barrel 29 terminates. Flat planar surface 50 has an annular recess 52 formed therein concentric and communicating with bore 28A. Tubular member 40 has an external diameter which is the same gauge as bore 28A and has an internal diameter which is the same gauge as smaller gauge shotgun shell 46. Tubular member 40 is provided with an external generally annular flange 54 at its rear end which fits within annular recess 52. Annular flange 54 includes a cut-out portion 56 (see FIG. 8). Movable component 42 comprises an external flange 60 which fits within cut-out portion 56 and within annular recess 52 in surface 50 of carrier barrel 29 when adapter 36 is installed in bore 28A and the movable component 42 is in retracted position (see FIG. 6).

As FIGS. 4, 6 and 7 show, flat planar surface 50 further comprises another recess 62 for accommodating member 48 of ejector/extractor 32A when the latter is in retracted position. As FIG. 4 shows, recess 62 intersects annular recess 52. As FIG. 6 and 8 shows, when adapter 36 is mounted in bore 28A of carrier barrel 29 and member 48 and movable component 42 are both in retracted position, a projecting portion 47 at the bottom of a groove 49 in member 48 is disposed behind and engaged with a projection 61 on external flange 60 on movable component 42 and is in position to effect sliding movement of component 42 toward extended extract position (see FIG. 7) or toward extended eject position (FIG. 8).

Figure 10:
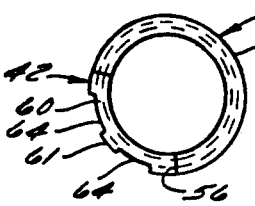
FIG. 10 is an end elevation view of the rear or breech end of the adapter of FIG. 9.

As FIGS. 8 and 10 show, member 48 and external flange 60 are designed to enable member 48 and movable component 42 to lie flush with planar surface 50 on carrier barrel 30 when both are retracted. Such means comprise two notches 64 in external flange 60 which receive the two projections 63 on member 48 which are located on opposite sides of groove 49.

Figure 9:
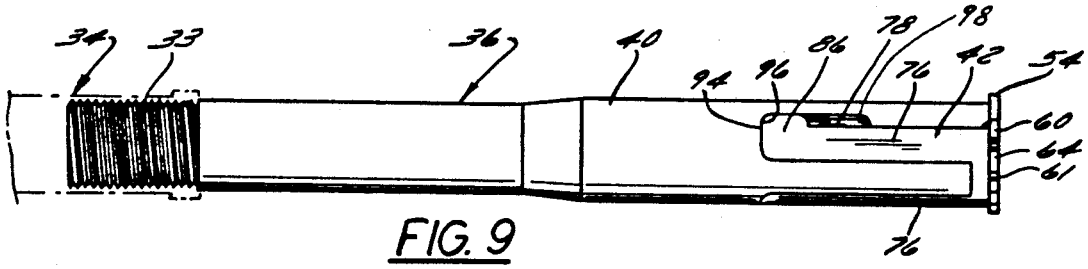
FIG. 9 is a side elevation view of the adapter of FIG. 8 showing it connected to the tube of FIG. 2 which is shown in phantom lines.
Figure 5:
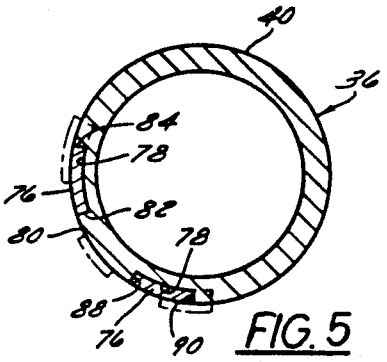
FIG. 5 is a cross-section view of the adapter taken on line 5—5 of FIG. 8.
Figure 6:
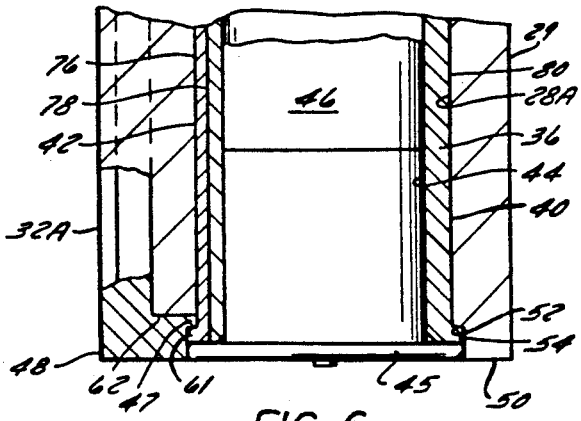
FIG. 6 is a cross-section view taken on line 6—6 of FIG. 4 of the breech end of a portion of the upper bore of the carrier barrel, the shell ejector/extractor thereon, the adapter therein and a smaller-gauge shotgun shell in the firing chamber of the adapter.

Referring to FIGS. 5, 8 and 9, movable component 42 is slidably mounted on tubular member 40 by means of two spaced-apart legs 76 which are received in two spaced apart grooves 78 which are formed in the outer surface 80 tubular member 40. Each leg 76 and the groove 78 in which it is disposed has an arcuate tranverse cross-sectional configuration (see FIG. 5). Each leg 76 is defined or bounded by spaced-apart parallel edges 82 and 84 and edge 84 is provided with a projection 86. Each groove 78 is defined or bounded by spaced-apart parallel edges 88 and 90 and edge 90 is provided with an elongated recess 92 which is longer in the axial direction than the projection 86 received therein. Inward movement of movable component 42 relative to tubular member 40 to its retracted position (FIG. 9) is limited by engagement of the end edge 94 of each leg 76 with the end edge 96 of its associated groove. Outward movement of movable component 42 relative to tubular member 40 to its maximum (i.e., shell eject) position (FIG. 8) is limited by engagement of the projection 86 with shoulders 98 formed on the edges 90 of the grooves 78. As FIG. 5 shows, since the parallel edges of the legs 76 and the grooves 78 are perpendicular to planes tangent to the curved outer surface 80 of tubular member 40 and are circumferentially spaced apart therearound, movable component 42 is trapped, but axially slidable, on tubular member 40.

I claim:

1. In a shotgun:

a detachable regular barrel with a bore of predetermined guage and having a shell ejector/extractor operable by an operating mechanism on said shotgun, said regular barrel with said ejector/extractor thereon having a predetermined weight and balance;

and means for replacing said detachable regular barrel to enable firing of a shotgun shell smaller than said predetermined guage, said means having the same weight and balance as that of said regular barrel with said shell ejector/extractor thereon, said means comprising:

a carrier barrel having an ejector/extractor thereon detachably mountable on said shotgun in place of said regular barrel and being of lighter weight and less strong than said regular barrel;

a tube insertable in said carrier barrel and adapted to have said smaller gauge shotgun shell fired therethrough;

and an adapter insertable in said carrier barrel for association with said tube and having a firing chamber therein for receiving said smaller gauge shotgun shell, said adapter comprising movable means operable by said ejector/extractor on said carrier barrel to effect ejection or extraction of said smaller guage shotgun shell.

2. Means for replacing a detachable regular barrel of predetermined weight and balance of a shotgun which is adapted to fire a shotgun shell of predetermined guage to enable firing of smaller gauge shotgun shell without affecting the weight and balance of the shotgun, said regular barrel having a shell ejector/extractor thereon operable by a mechanism on said shotgun, said means comprising:

a carrier barrel detachably mountable on said shotgun in place of said regular barrel and having a shell ejector/extractor thereon operable by said mechanism, said carrier barrel being structurally weaker than said regular barrel and subject to damage if a shotgun shell adapted for firing in said regular barrel is fired therein;

a tube mountable in said carrier barrel and adapted to have said smaller gauge shotgun shell fired therethrough;

and an adapter mountable in said carrier barrel and connectable to said tube for receiving said smaller gauge shotgun shell which is to be fired therein and having a movable component thereon operable by said shell ejector/extractor on said carrier barrel to eject or extract said smaller gauge shotgun shell from said adapter;

said adapter when mounted in said carrier barrel preventing insertion into said carrier barrel of a shotgun shell of predetermined gauge adapted for firing in said regular barrel;

said carrier barrel with its ejector/extractor thereon, said tube and said adapter with said movable component thereon having a combined weight matching the weight of said regular barrel with its ejector/extractor thereon and being configured, sized and arranged to match the balance of said regular barrel with its ejector/extractor thereon.

3. Means according to claim 2 wherein said adapter is a tubular member having a firing chamber therein for receiving said smaller gauge shotgun shell, and wherein said movable component is slidably mounted on said tubular member and is engaged with a flange on the base of said smaller gauge shotgun shell when the shell is disposed in said firing chamber, said movable component being engageable with and movable by said ejector/extractor on said carrier barrel when said adapter is disposed in said carrier barrel.

4. Means according to claim 3 wherein said ejector/extractor on said carrier barrel comprises a member which is engageable with said movable component and is slidably movable between a retracted position and an extended position and wherein said movable component is slidably movable between a retracted being movable from retracted position to extended position in response to movement of said member from retracted position to extended position to eject or extract said smaller gauge shotgun shell from said firing chamber.

5. Means according to claim 4 wherein said carrier barrel has a flat planar surface at its breech end whereat a bore in said carrier barrel terminates; wherein said bore has the same gauge as said predetermined gauge; wherein said flat planar surface has an annular recess formed therein concentric and communicating with said bore; wherein said tubular member has an external diameter which is the same gauge as said bore and has an internal diameter which is the same gauge as said smaller gauge shotgun shell; wherein said tubular member is provided with an external generally annular flange at its rear end which fits within said annular recess; wherein said annular flange includes a cut-out portion; wherein said movable component comprises an external flange which fits within said cut-out portion and within said annular recess when said adapter is installed in said bore and said movable component is in retracted position; wherein said flat planar surface further comprises another recess for accommodating said member when the latter is in retracted position, said other recess intersecting said annular recess; whereby, when said adapter is mounted in the bore of said carrier barrel and said member and said movable component are both in retracted position, a portion of said member is disposed behind and engaged with said external flange on said movable component and in position to effect sliding movement thereof toward extended position.

6. An adapter for disposition in the bore of a shotgun carrier barrel which replaces a detachable regular barrel in said shotgun and which has an ejector/extractor thereon to enable a shotgun shell of smaller guage than said bore to be fired but to prevent insertion of a shotgun shell of the same guage as said bore and to enable the smaller guage shotgun shell to be ejected or extracted from the adapter in response to operation of said ejector/extractor on said carrier barrel, said adapter comprising:

a tubular member for insertion in the carrier barrel bore defining a firing chamber for receiving said smaller gauge shotgun shell;

and a component movably mounted on said tubular member and engageable with smaller gauge shotgun shell in said firing chamber and engageable with said ejector/extractor on said carrier barrel, said component being movable from a retracted position to an extended position in response to movement of said ejector/extractor from a retracted position to an extended position, respectively, to effect ejection or extraction of said smaller gauge shotgun shell from said firing chamber, said carrier barrel with said ejector/extractor thereon, said tubular member and said component having the same weight and balance as that of said regular barrel and the ejector/extractor thereon.

7. An adapter according to claim 6 wherein said component is slidably mounted on the exterior of said tubular member; wherein said tubular member and said component each have flange portions thereon which cooperate to define an annular flange when said component is in retracted position which fits within an annular recess formed in a flat planar surface defining the breech end of said carrier barrel around said bore; and wherein the flange portion on said component is engageable with said ejector/extractor when said adapter is installed in said bore of said carrier barrel.

8. An adapter according to claim 7 wherein said flange portion on said component includes a projection which is adapted to fit within a recess formed in said ejector/retractor of said carrier barrel.

9. An adapter according to claim 6 or 7 or 8 wherein said tubular member has an outside diameter which is the same gauge as the bore of said carrier barrel and has an inside diameter which is the same gauge as said smaller gauge shotgun shell.

10. An adapter according to claim 9 wherein said component includes at least one leg connected to said flange portion of said component and wherein said tubular member has at least one groove formed in its outside surface wherein said leg is slidably received.

11. An adapter according to claim 6 wherein said tubular member is provided with threads which adapt it for threaded engagement with a tube to be installed in said bore of said carrier barrel.

12. An adapter for disposition in the bore of a shotgun carrier barrel having an ejector/extractor thereon to enable a shotgun shell of smaller gauge than said bore to be fired but to prevent insertion of a shotgun shell of the same gauge as said bore and to enable the smaller gauge shotgun shell to be ejected or extracted from the adapter in response to operation of said ejector/extractor on said carrier barrel, said adapter comprising:

a tubular member for insertion in the carrier barrel bore defining a firing chamber for receiving said smaller gauge shotgun shell, said tubular member having an outside diameter which is the same guage as the bore of said carrier barrel and has an inside diameter which is the same guage as said smaller gauge shotgun shell;

and a component slidably mounted on the exterior of said tubular member and engageable with a smaller guage shotgun shell in said firing chamber and engageable with said ejector/extractor on said carrier barrel, said component being movable from a retracted position to an extended position in response to movement of said ejector/extractor from a retracted position to an extended position, respectively, to effect ejection or extraction of said smaller gauge shotgun shell from said firing chamber;

said tubular member and said component each having flange portions thereon which cooperate to define an annular flange when said component is in retracted position, which annular flange fits within an annular recess formed in a flat planar surface defining the breech end of said carrier barrel around said bore, the flange portion on said component being engageable with said ejector/extractor when said adapter is installed in said bore of said carrier barrel, said flange portion on said component including a projection which is adapted to fit within a recess formed in said ejector/retractor of said carrier barrel, said component including two circumfertially spaced apart legs connected to the flange portion of said component and said tubular member having two circumferentially spaced apart grooves formed in its outside surface wherein said legs are slidably received.

13. An adapter according to claim 12 including interengageable means on said tubular member and on said component to limit axial sliding movement of said component relative to said tubular member between said extended and said retracted positions.

* * * * *